US012616323B2

(12) United States Patent
Conohan

(10) Patent No.: US 12,616,323 B2
(45) Date of Patent: May 5, 2026

(54) CONTAINER FOR A SUBSTANCE

(71) Applicant: Jonathan Paul Conohan, Manotick (CA)

(72) Inventor: Jonathan Paul Conohan, Manotick (CA)

( * ) Notice: Subject to any disclaimer, the term of this patent is extended or adjusted under 35 U.S.C. 154(b) by 67 days.

(21) Appl. No.: 17/719,054

(22) Filed: Apr. 12, 2022

(65) Prior Publication Data

US 2022/0322855 A1 Oct. 13, 2022

Related U.S. Application Data

(60) Provisional application No. 63/174,430, filed on Apr. 13, 2021.

(51) Int. Cl.
*A47G 19/22* (2006.01)

(52) U.S. Cl.
CPC ..... *A47G 19/2227* (2013.01); *A47G 19/2272* (2013.01); *A47G 2019/2244* (2013.01)

(58) Field of Classification Search
CPC ..... A47G 19/2227; A47G 19/2272; A47G 2019/2244; A47G 2200/143
USPC ..... 220/4.01; 446/416
See application file for complete search history.

(56) References Cited

U.S. PATENT DOCUMENTS 1,739,451 A * 12/1929 Fowler ..... A63H 5/00 446/81
2,107,981 A * 2/1938 Ford ..... A47G 19/2227 215/398
5,070,539 A * 12/1991 Cheng ..... A47G 23/0216 455/344
5,501,363 A * 3/1996 Muller ..... G10K 11/08 220/709
5,967,405 A * 10/1999 Hanauska ..... B65D 81/365 181/178
D782,248 S * 3/2017 Kushner ..... D10/119.3
2006/0201330 A1* 9/2006 Cohen ..... G10K 9/04 99/275
2007/0194030 A1* 8/2007 Bakti ..... A47G 19/2227 446/81
2016/0286993 A1* 10/2016 Pau ..... A47G 19/2288
2021/0212485 A1* 7/2021 Attar ..... A47G 19/2227

FOREIGN PATENT DOCUMENTS

FR 2856182 A1 12/2004

* cited by examiner

*Primary Examiner* — Nathan J Jenness
*Assistant Examiner* — Madison L Poos
(74) *Attorney, Agent, or Firm* — The Roy Gross Law Firm, LLC; Roy D. Gross

(57) ABSTRACT

The present invention describes a container which is capable of creating a sound through the displacement of air within a channel in the container.

8 Claims, 15 Drawing Sheets

CONTAINER FOR A SUBSTANCE

CROSS REFERENCE TO RELATED APPLICATIONS

This application claims the benefit of priority to U.S. provisional 63/174,430 filed on Apr. 13, 2021. The contents of this application are incorporated by reference in their entirety.

FIELD OF THE INVENTION

The present invention pertains to the field of containers and more specifically to a container for a substance which can produce a sound.

BACKGROUND OF THE INVENTION

Noise makers come in various forms and attempts have been made to incorporate such noise makers in various items. There is a need for a noise maker incorporated within a container to provide noise on demand.

SUMMARY OF THE INVENTION

The present invention provides a container for a substance comprising a vessel to receive the substance and a shell interconnected to the vessel having a channel for passage of air within the channel. The container also has a port in fluid communication with the channel and a bladder positioned on the shell to produce a sound when air is displaced in the channel.

BRIEF DESCRIPTION OF THE DRAWINGS

The embodiments of the present invention will now be described by reference to the following figures, in which identical reference numerals in different figures indicate identical elements and in which.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION OF THE INVENTION

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

Figure 1A:
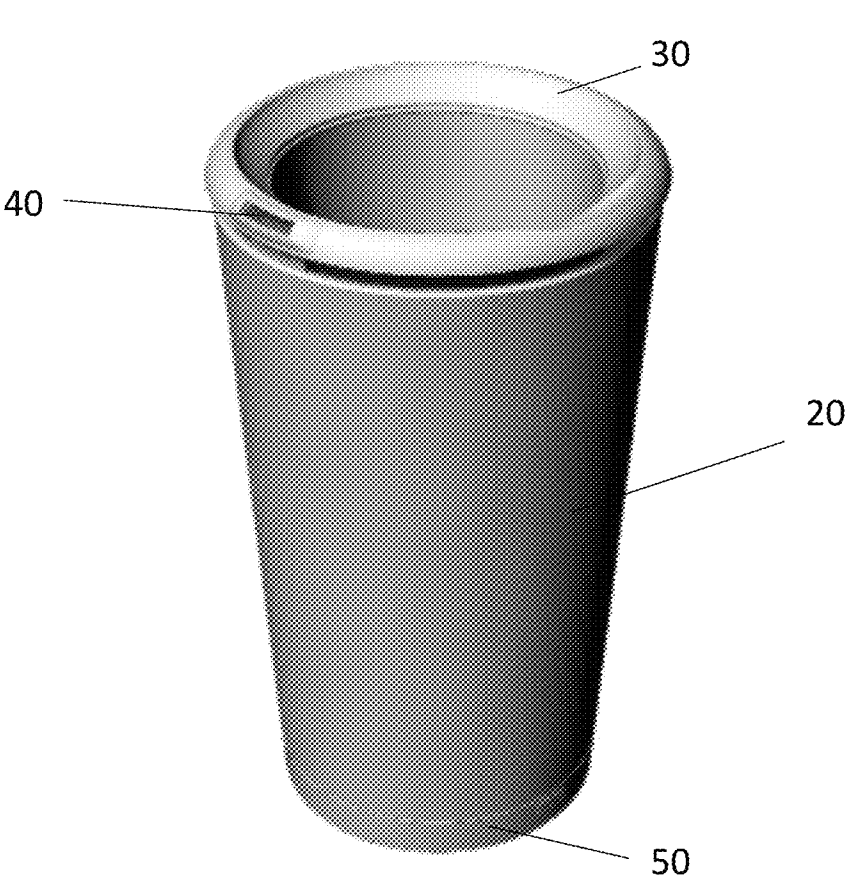
FIG. 1A is a perspective view of a container according to one embodiment of the present invention.
Figure 1B:
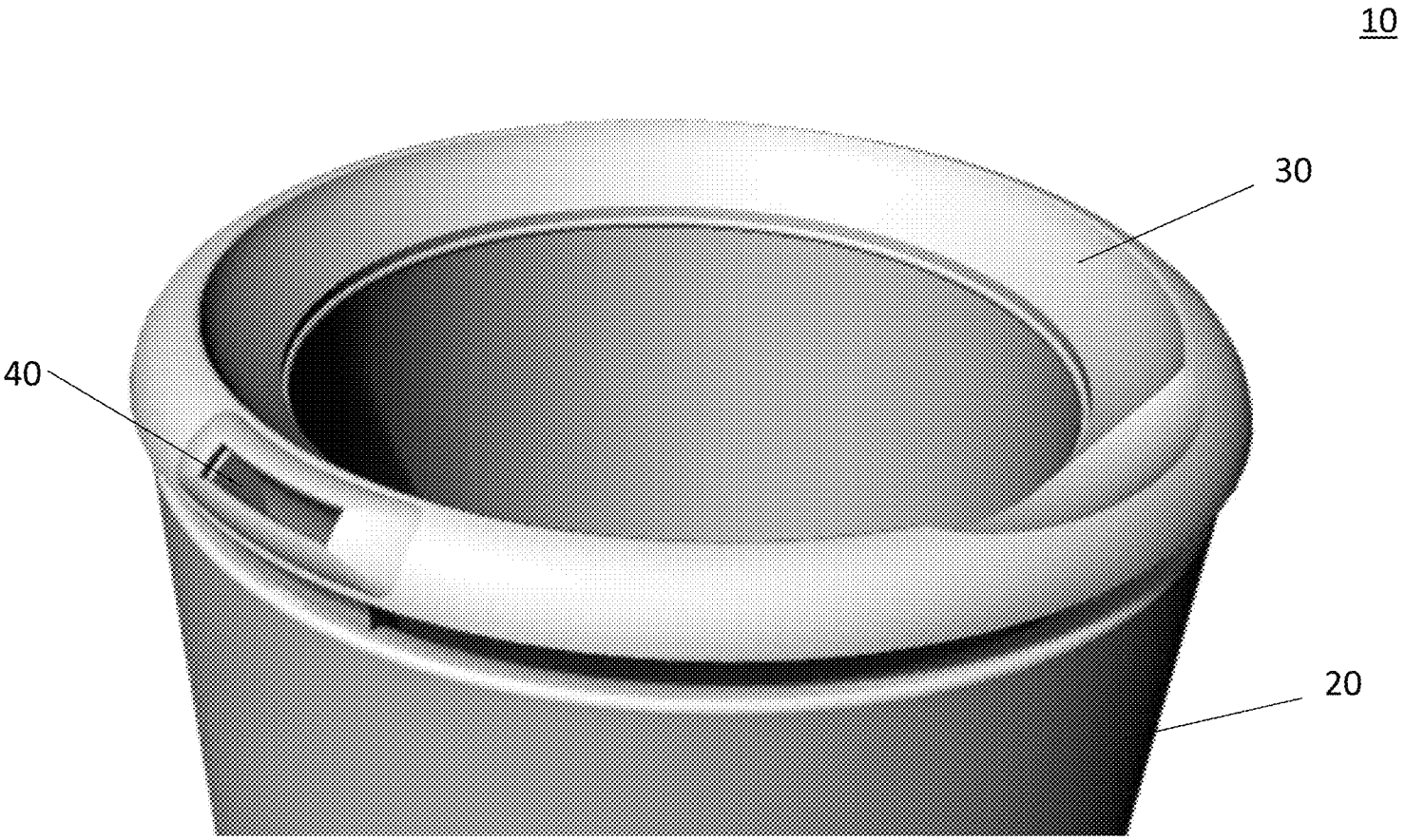
FIG. 1B is a top perspective view of a container according to one embodiment of the present invention.

With reference to FIGS. 1A and 1B and according to one embodiment of the present invention, a container 10 is shown having a shell 20 and a vessel 30. A port 40 is positioned on vessel 30 allowing for fluid communication with a channel (not shown). Container 10 also has a cap 50 secured to the bottom of container 10 which bottom cap 50 secures a bladder (not shown) to container 10.

Figure 2A:
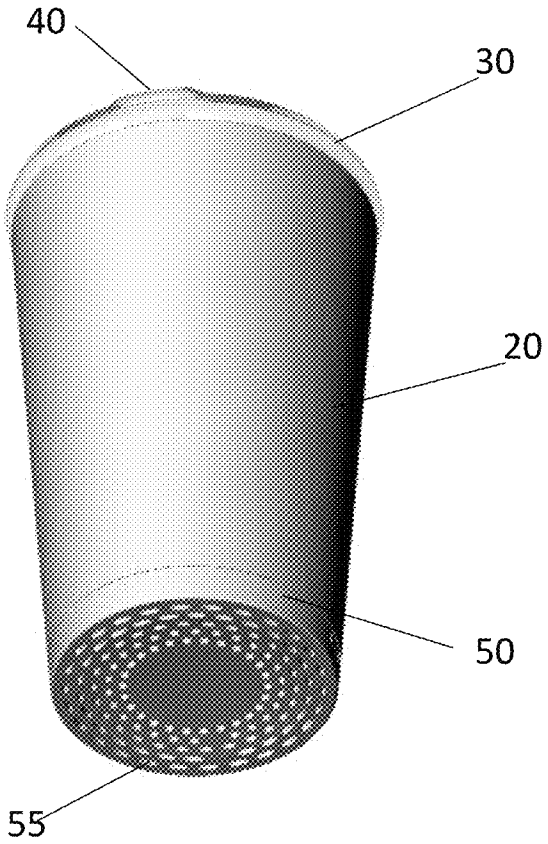
FIG. 2A is a bottom perspective view of a container according to one embodiment of the present invention.
Figure 2B:
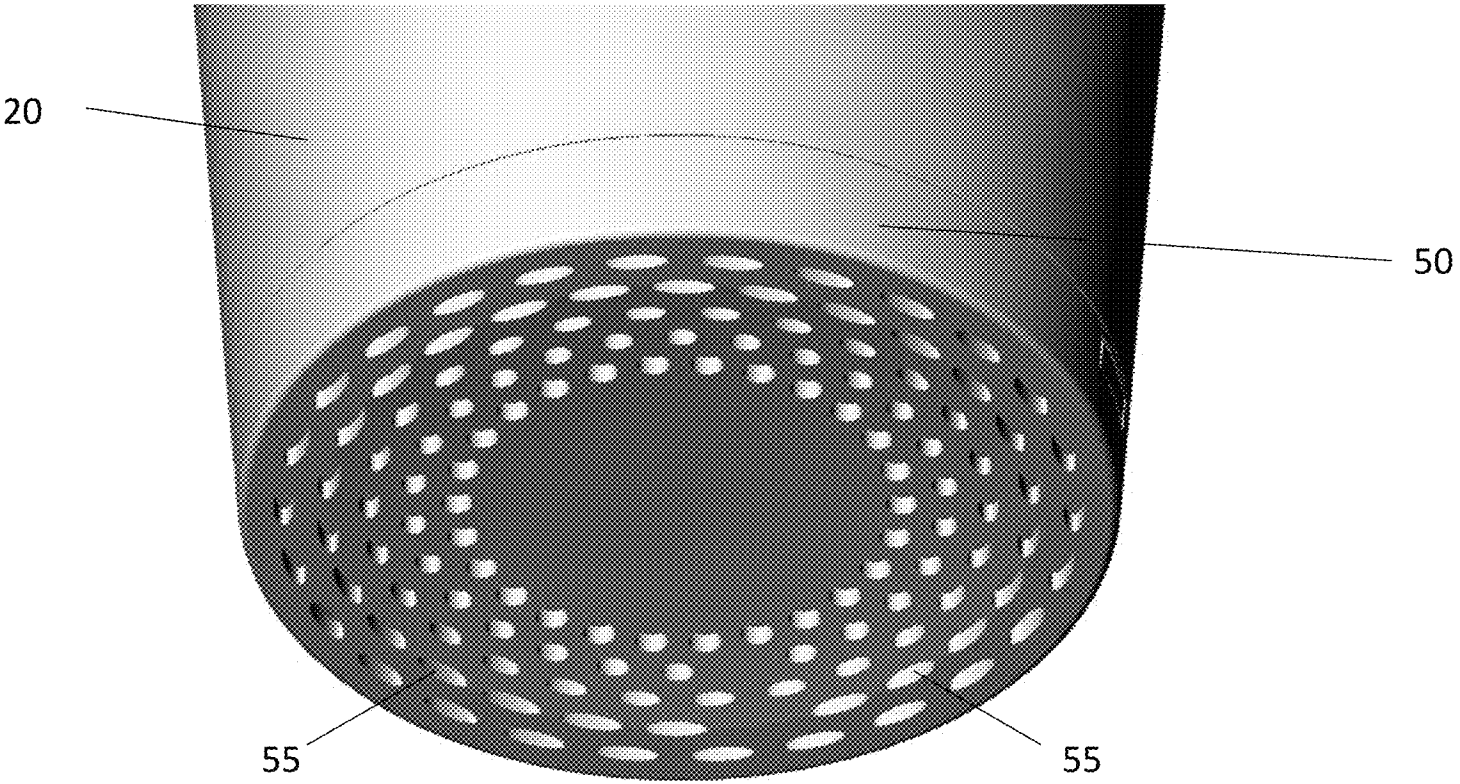
FIG. 2B is a bottom perspective view of a container with a bottom cap with openings according to one embodiment of the present invention.

With reference to FIGS. 2A and 2B and according to one embodiment of the present invention, cap 50 is shown secured to container 10. Cap 50 has openings 55 allowing for the passage of a sound or noise when air is applied to the bladder (not shown). Openings 55 can be numerous as shown on bottom cap 50 or can consist of only a few protrusions. The shape of the protrusions can vary and only requires sound to travel through bottom cap 50.

Figure 3:
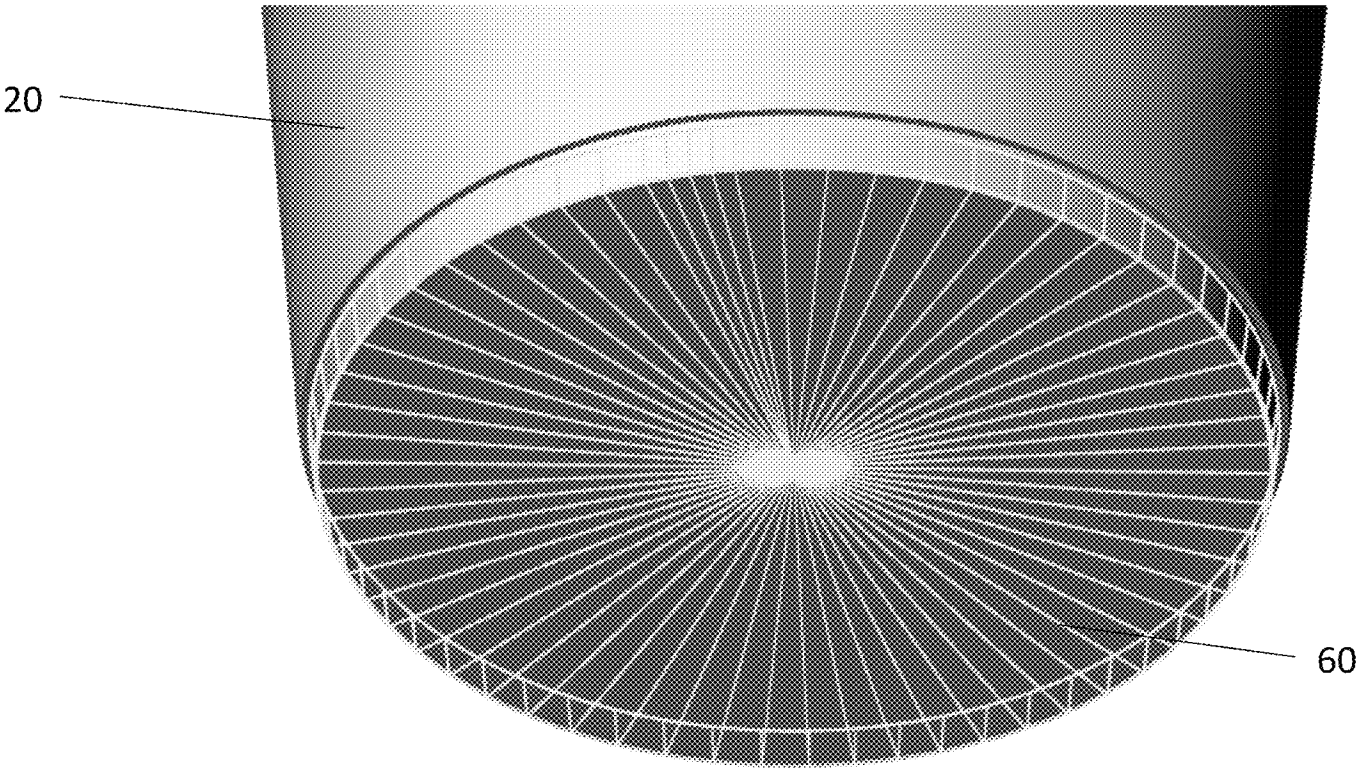
FIG. 3 is a bottom perspective view of a container with a bladder according to one embodiment of the present invention.

With reference to FIG. 3 and according to one embodiment of the present invention, a bladder 60 is shown positioned on the bottom portion of a container. The bladder 60 (shown as a web for illustrative purpose only) is secured to the container through the use of the bottom cap (not shown) and allows for a sound to be produced as will be further described below. Bladder 60 is a solid membrane which can be made of a rubber material or a reed or any other material which will produce a sound or noise.

Figure 4:
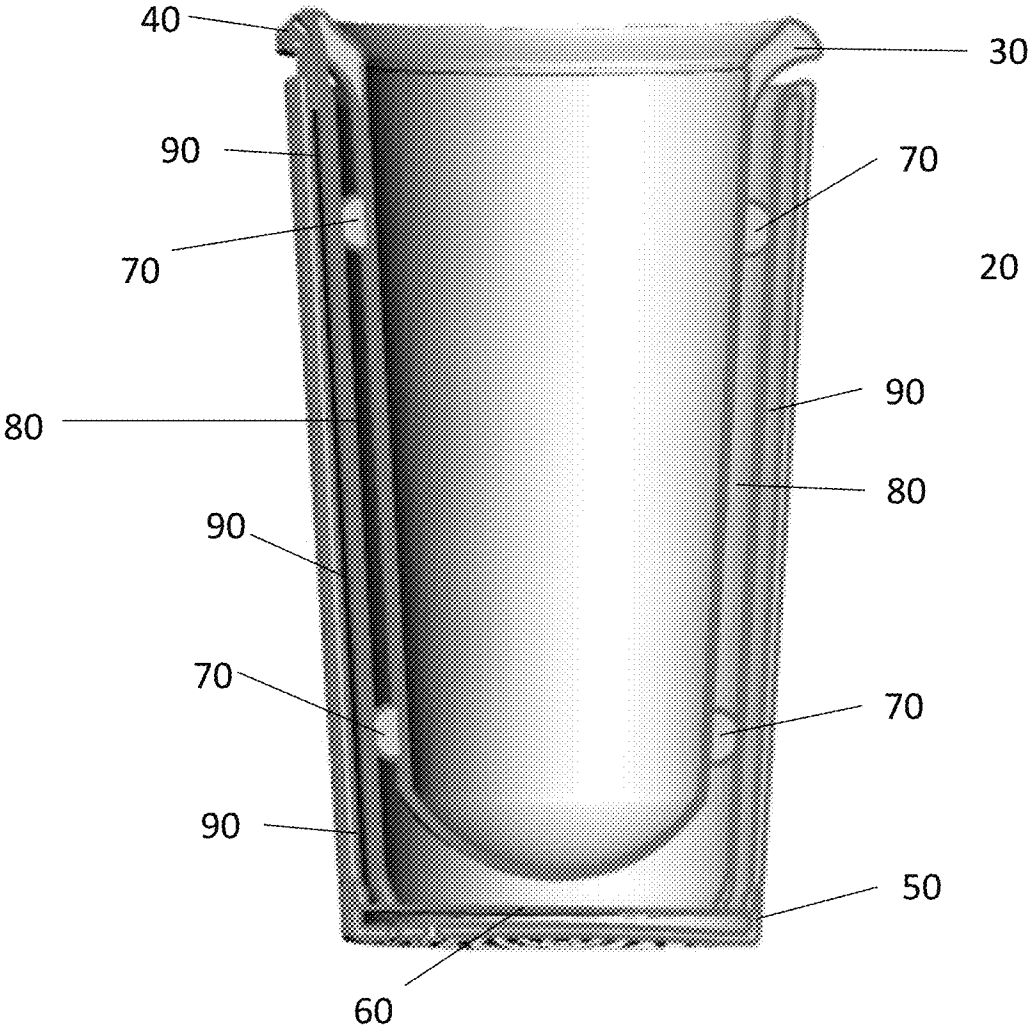
FIG. 4 is a cross-section view of a container according to one embodiment of the present invention.

With reference to FIG. 4 and according to one embodiment of the present invention, container 10 is shown having shell 20 and vessel 30 with bottom cap 50. Shell 20 is interconnected to vessel 30 through ribs 70 providing a gap 80 between shell 20 and vessel 30. Ribs 70 can consist of simple protrusions or any other spacer as would be known by a worker skilled in the relevant art allowing for a gap to be present between shell 20 and vessel 30. Shell 20 also has a channel 90 in fluid communication with port 40 with said channel 90 traveling along the length of shell 20.

Figure 5:
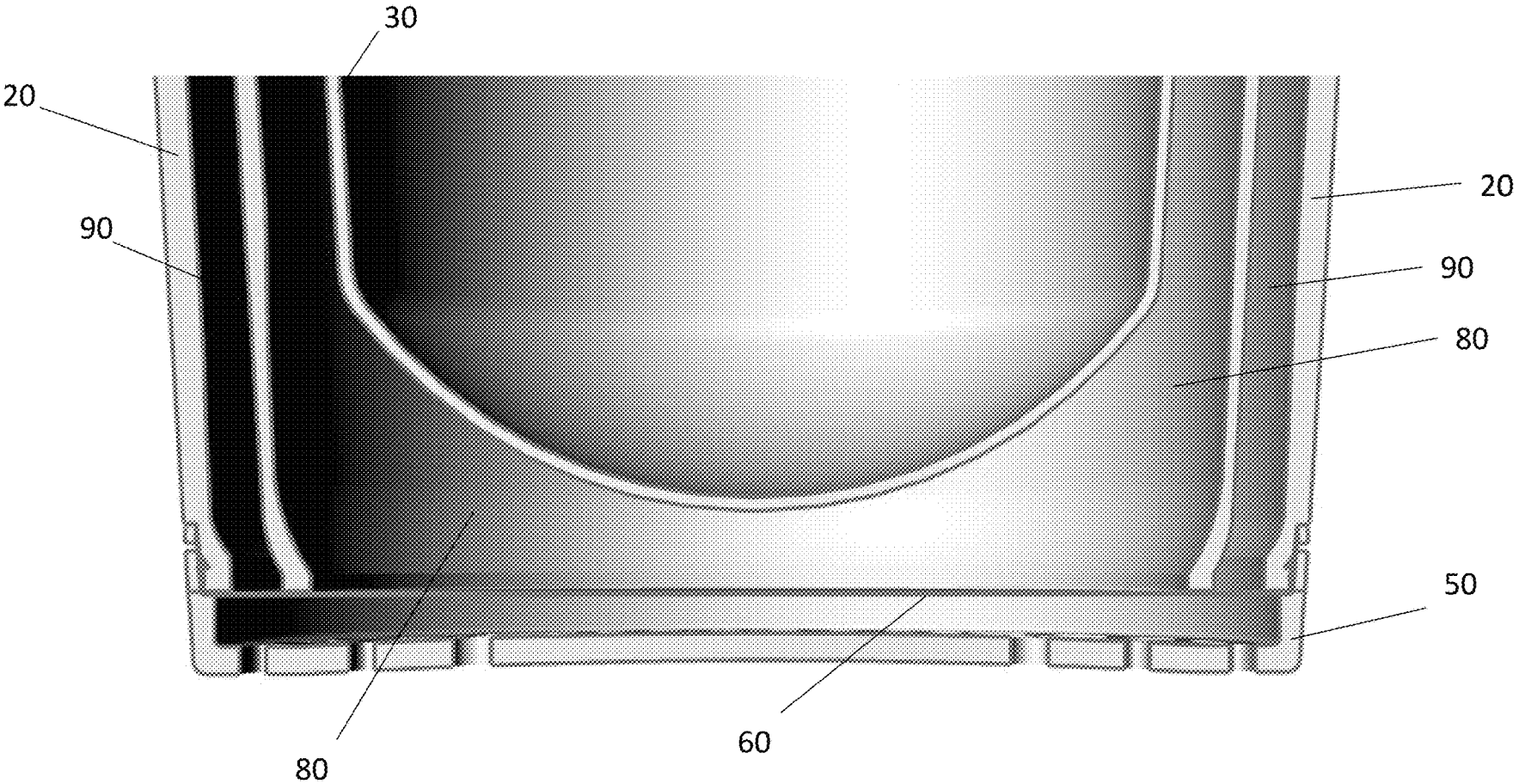
FIG. 5 is a cross-section view of the bottom portion of a container with a bladder according to one embodiment of the present invention.

With reference to FIGS. 4 and 5 and according to one embodiment of the present invention, channel 90 allows for the travel of air to bladder 60 secured to the bottom portion of container 10.

Figure 6:
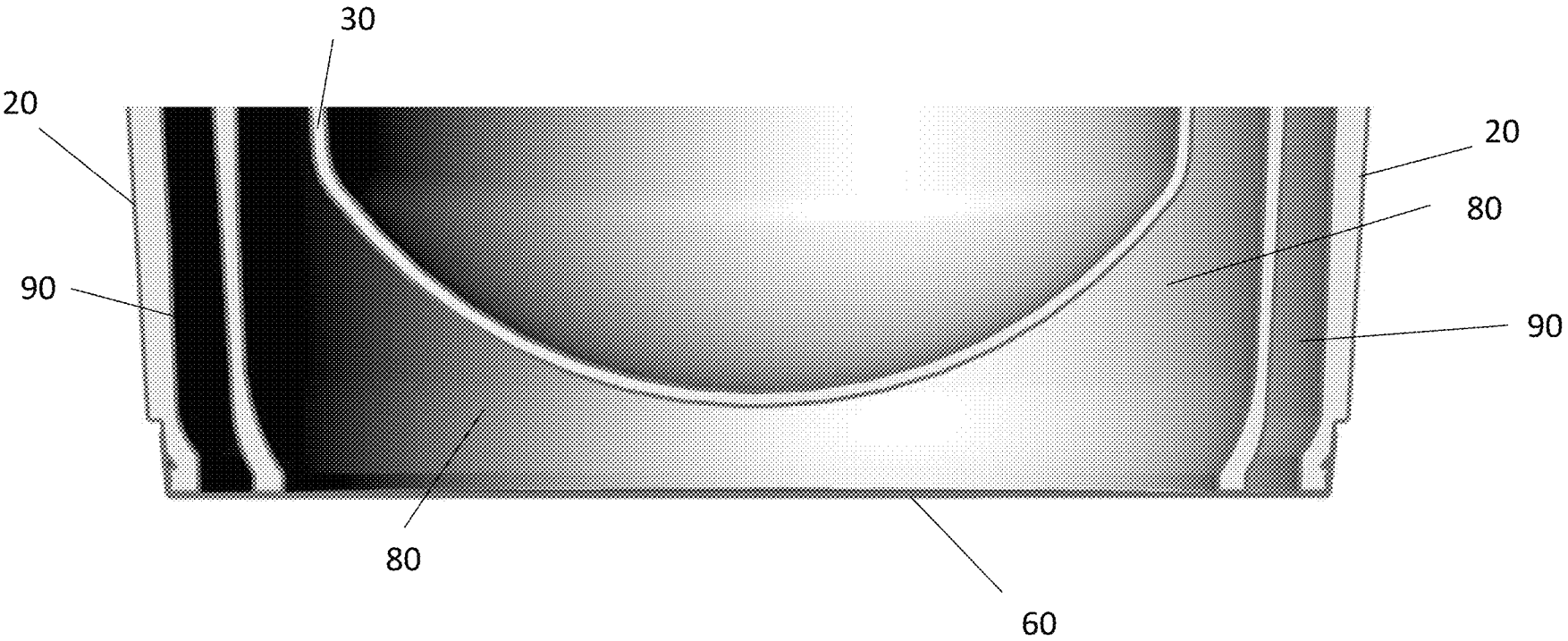
FIG. 6 is a cross-section view of the bottom portion of a container with a bladder without a bottom cap according to one embodiment of the present invention.
Figure 7:
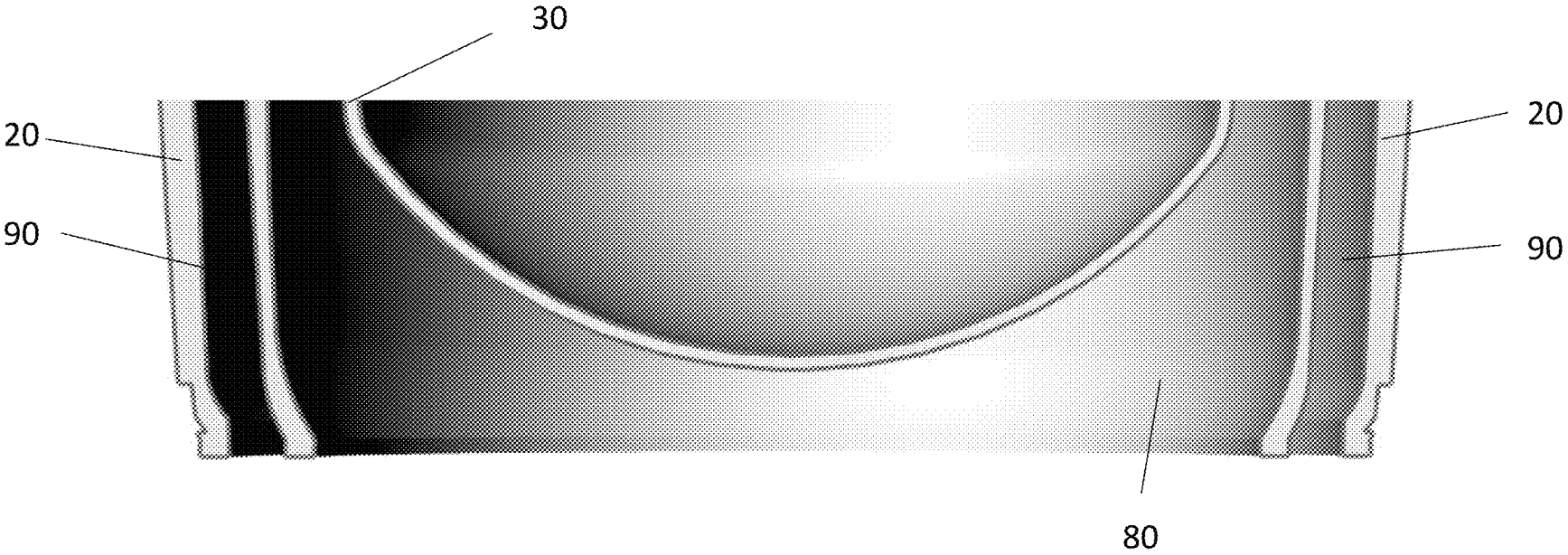
FIG. 7 is a cross-section view of the bottom portion of a container without a bladder according to one embodiment of the present invention.

With reference to FIGS. 6 and 7 and according to one embodiment of the present invention, bottom portion of container 10 is shown with and without the bladder positioned on the container. FIG. 6 shows bladder 60 positioned on the container with the outer edges of bladder 60 overlapping the edges of shell 20. The bladder may consist of an elastic material made from silicone, synthetic rubber, neoprene rubber or any other elastomer product as would be known by a worker skilled in the relevant art. The bladder 60 must allow for movement and vibration of the bladder when air is applied to the bladder. Such vibration or movement will in turn produce a sound. The sound will travel either through the bottom cap (not shown) or within the gap 80 between vessel 30 and shell 20.

Figure 8:
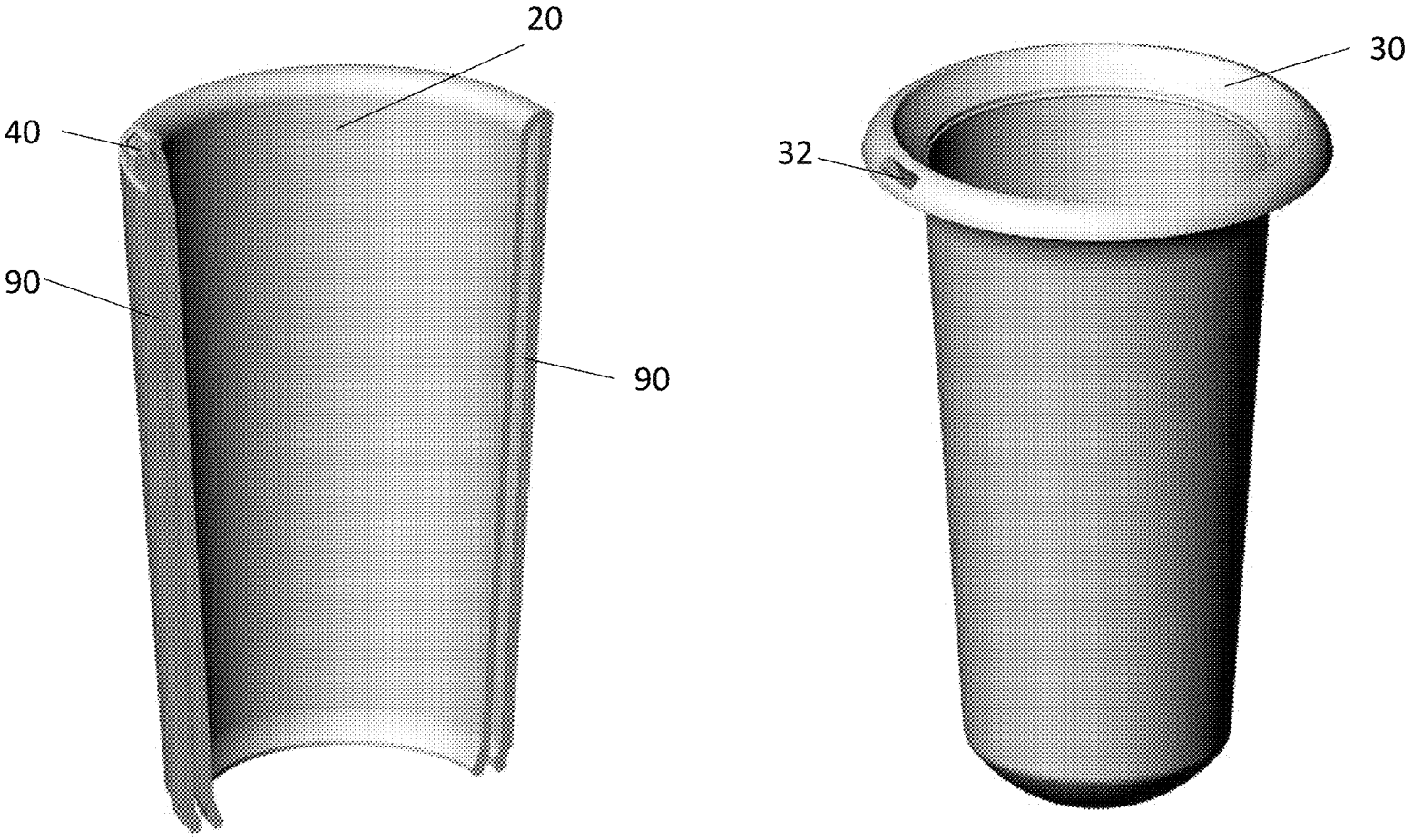
FIG. 8 is a perspective view of a vessel and a cross-section view of a shell according to one embodiment of the present invention.

With reference to FIG. 8 and according to one embodiment of the present invention, a cross-section of a shell 20 and a vessel 30 as would be used in a container is shown. Vessel 30 has a port adapter 32 for interconnecting with port 40 on shell 20. In another embodiment, vessel 30 may not have port adapter 32 as port 40 can be solely positioned on shell 30.

With further reference to FIG. 8 and according to one embodiment of the present invention, air can travel within channel 90 of shell 20 when air is applier to port 40. Movement of air within channel 90 will provide a pressure on the bladder (not shown) positioned on the bottom portion of the container through the bottom cap (not shown). Arrows in FIG. 9 illustrate the displacement of air within channel 90 to reach the bladder.

Figure 9:
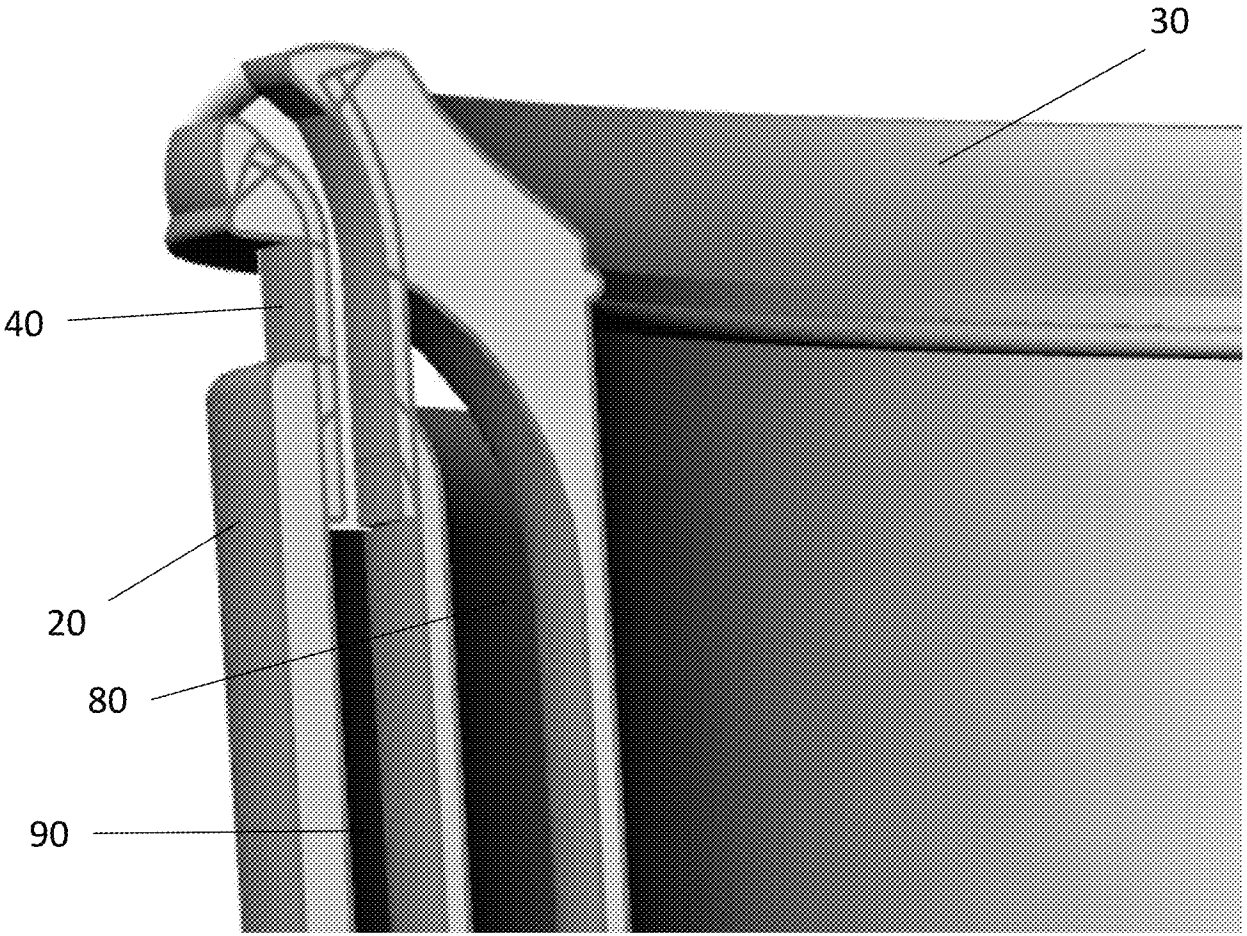
FIG. 9 is a cross-section view of a port in fluid communication with a channel positioned in a container according to one embodiment of the present invention.

With reference to FIG. 9 and according to one embodiment of the present invention, port 40 is shown in fluid communication with channel 90 of shell 20. Port 40 can be part of vessel 30 as shown or can be independent of vessel 30 such that port 40 is not connected or in contact with vessel 30. Port 40 can be a separate component positioned on top of channel 90 or can be uniformed with channel 90.

Figure 10:
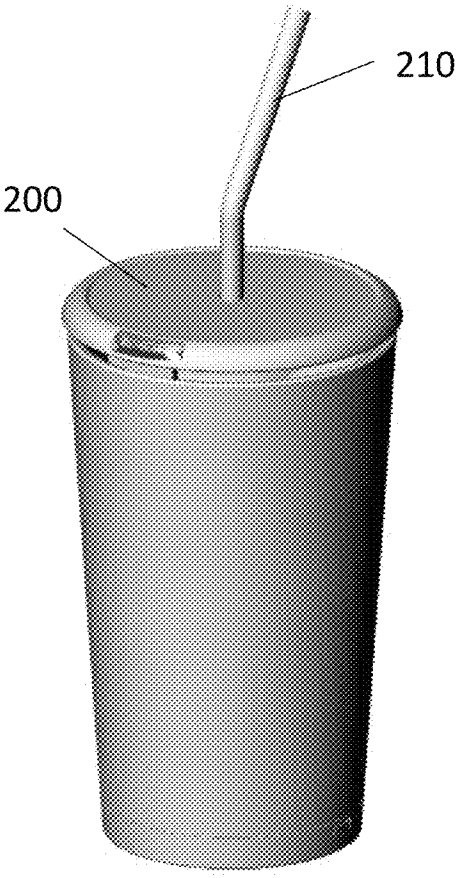
FIG. 10 is a perspective view of a container according to another embodiment of the present invention.

With reference to FIG. 10 and according to another embodiment of the present invention, a container is shown with a cover 200 and a straw 210. Cover 200 can cover or not cover port 40, however, if cover 200 covers port 40 then a sound cannot be produced.

Figure 11:
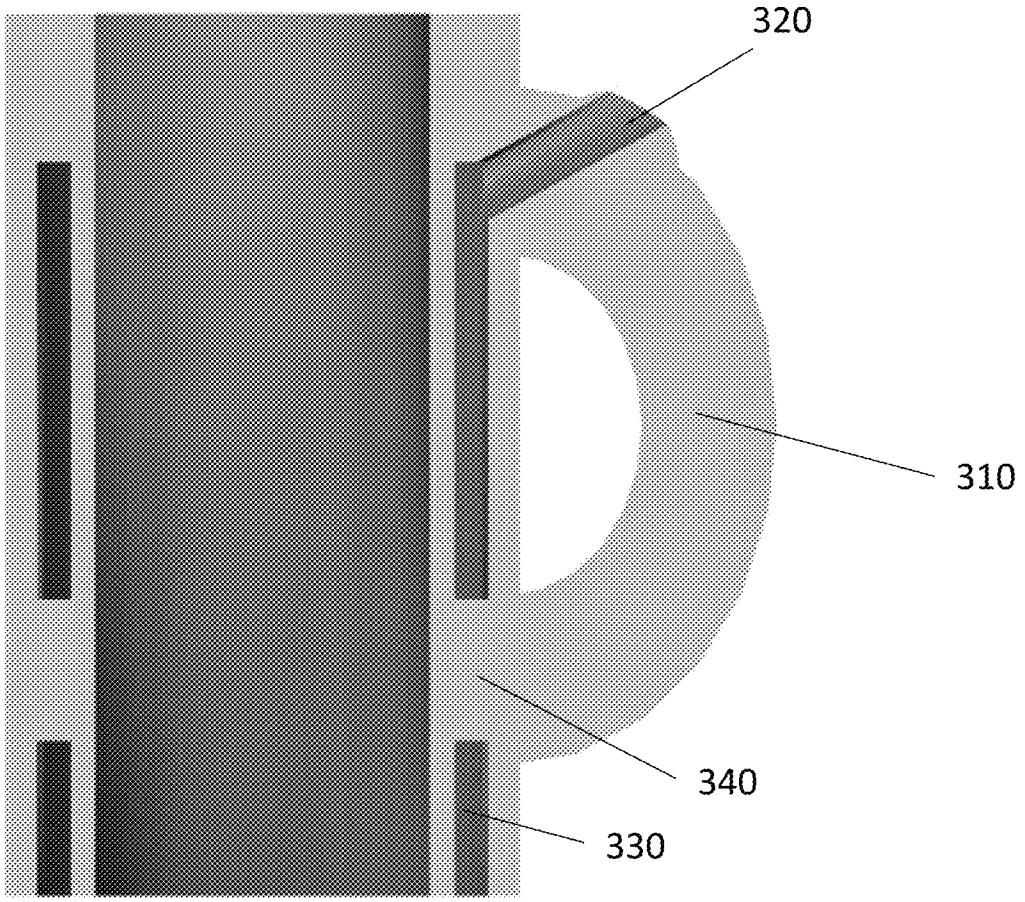
FIG. 11 is a sectional view of a container in the form of a mug according to another embodiment of the present invention.
Figure 12:
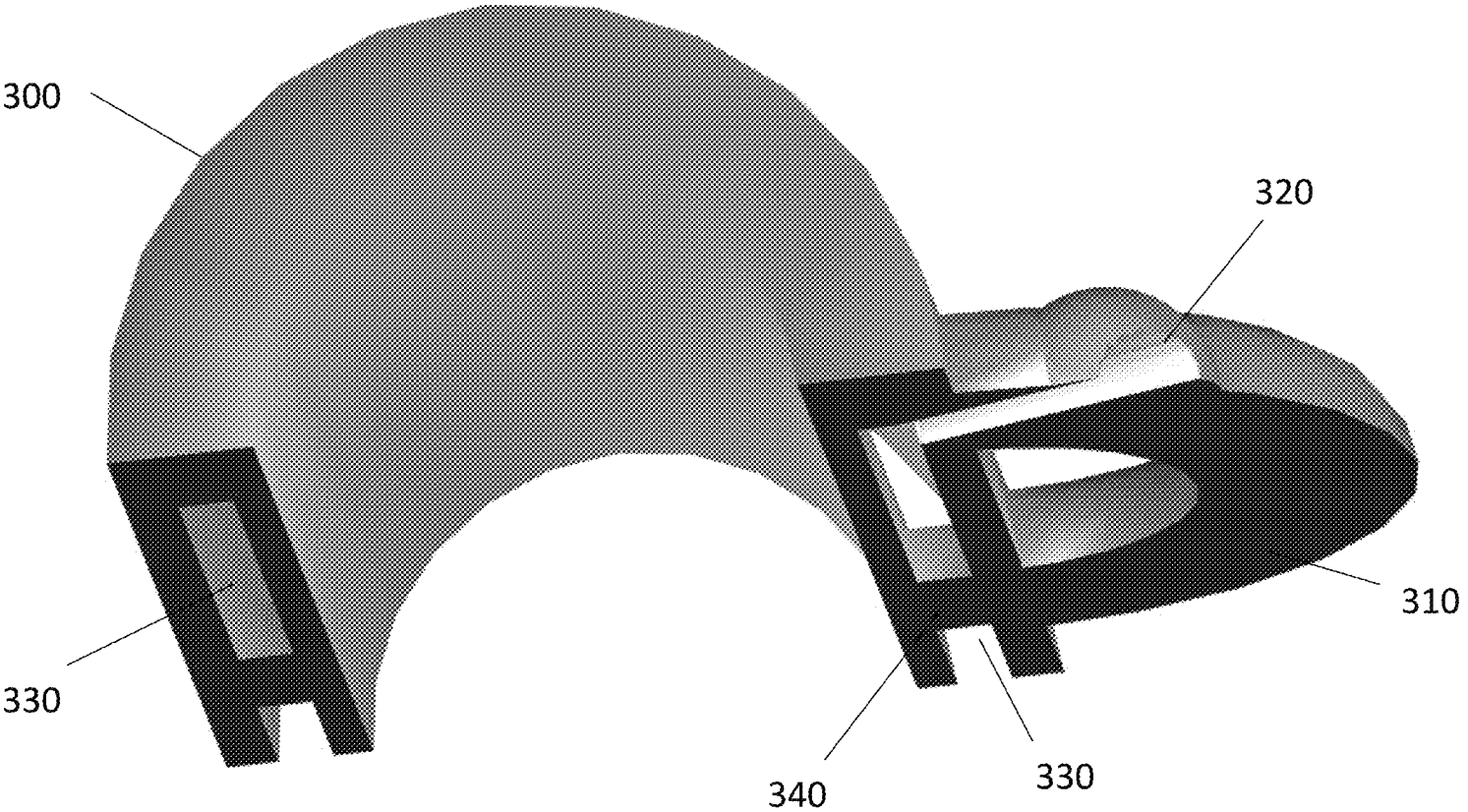
FIG. 12 is a sectional perspective view of a container in the form of a mug according to another embodiment of the present invention.

With reference to FIGS. 11 and 12 and according to another embodiment of the present invention, a container is shown in the form of a mug 300 having a handle 310 with a port 320 on handle 310. Port 320 allows for air to be in fluid communication with channel 330. Air will travel in channel 330 to the bottom of mug 300 in order to create a sound through the use of a bladder (not shown) but described above. Support 340 is present within channel 330 for structural integrity of the container since channel 330 surrounds container 300. With specific reference to FIG. 12 and according to one embodiment of the present invention, support 340 is shown as a single solid piece which does not surround the container within channel 330.

Figure 13:
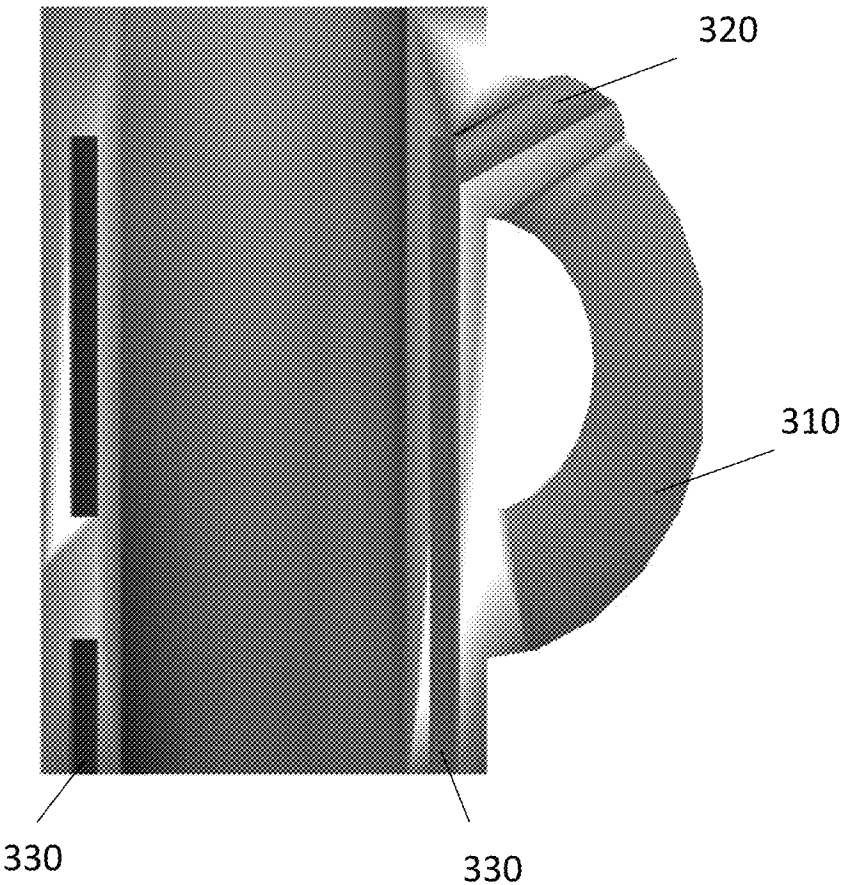
FIG. 13 is a sectional view of a container in the form of a mug without a support according to another embodiment of the present invention.

With reference to FIG. 13 and according to one embodiment of the present invention, a container 300 is shown without the presence of support 340 near handle 310 and in channel 330 near handle 310.

The present invention can contain a number of containers having ports located within different locations on the container as long as the port is in fluid communication with the channel and bladder.

A container of the present invention could be made from a number of different materials such as plastic, paper, glass or any other material as would be known by a worker skilled in the relevant art.

A person understanding this invention may now conceive of alternative structures and embodiments or variations of the above all of which are intended to fall within the scope of the invention as defined in the claims that follow.

The present invention provides in one embodiment a container for a substance comprising:

A vessel to receive the substance;

A shell interconnected to the vessel having a channel for passage of air within the channel;

A port in fluid communication with the channel; and

A bladder positioned on the shell to produce a sound when air is displaced in the channel.

The container may further comprise a gap between the vessel and the shell for placement of the shell within the container.

The container may further comprise ribs providing the gap between the vessel and the shell.

The container may further comprise a cap secured to container.

The container may further comprise openings allowing for the passage of sound or noise when air is applied to the bladder.

The container may further comprise a bladder made of rubber material which will produce a sound or noise.

The container may further comprise a cover for placement on the container.

The container may further comprise a port adapter on the vessel for interconnecting with port on shell.

The invention claimed is:

1. A container for a substance comprising:

a vessel to receive the substance;

a shell interconnected to the vessel, the shell having a channel for passage of air within the channel, wherein the vessel is housed within the shell;

a port in fluid communication with the channel; and, a bladder positioned on a bottom portion of the shell between an inner surface of the shell and an outer surface of the vessel, wherein the bladder is configured to produce a sound when air is displaced in the channel, wherein the bladder produces the sound while the vessel contains the substance.

2. The container according to claim 1 further comprising a gap between the vessel and the shell for placement of the shell within the container.

3. The container according to claim 1 further comprising a cap secured to container.

4. The container according to claim 3 further comprising openings allowing for the passage of sound or noise when air is applied to the bladder.

5. The container according to claim 1, wherein the bladder is made of a rubber material which will produce a sound or noise.

6. The container according to claim 1 further comprising a cover for placement on the container.

7. The container according to claim 1 further comprising a port adapter on the vessel for interconnecting with the port on shell.

8. A container for a substance comprising:

a vessel to receive the substance;

a shell interconnected to the vessel, the shell having a channel for passage of air within the channel;

a gap between the vessel and the shell for placement of the shell within the container;

a port in fluid communication with the channel;

a bladder positioned on the shell to produce a sound when air is displaced in the channel; and, ribs providing the gap between the vessel and the shell.

* * * * *